US005220381A

United States Patent [19]

Suzuki

[11] Patent Number: 5,220,381

[45] Date of Patent: Jun. 15, 1993

[54] ELECTROPHOTOGRAPHIC IMAGE FORMING APPARATUS WITH PROCESS CARTRIDGE

[75] Inventor: Toshiya Suzuki, Iwate, Japan

[73] Assignee: Alps Electric Co., Ltd., Tokyo, Japan

[21] Appl. No.: 879,631

[22] Filed: May 7, 1992

[30] Foreign Application Priority Data

May 13, 1991 [JP] Japan ..... 3-107129

[51] Int. Cl.[5] ..... G03G 15/00

[52] U.S. Cl. ..... 355/212; 355/210

[58] Field of Search ..... 355/212, 211, 210, 200, 355/237, 238

[56] References Cited

U.S. PATENT DOCUMENTS 4,540,268 9/1985 Toyono .
4,598,993 7/1986 Mizutani et al. .
4,609,276 9/1986 Mitzutani .
4,699,494 10/1987 Honda .
4,791,454 12/1988 Takahashi et al. .
4,806,977 2/1989 Mizutani et al. .
4,835,568 5/1989 Howard et al. ..... 355/219
4,875,077 10/1989 Takamatsu et al. ..... 355/212
4,975,744 12/1990 Ebata et al. ..... 355/211
5,041,851 8/1991 Nelson ..... 346/160
5,062,003 10/1991 Kawabata ..... 355/202 X

*Primary Examiner*—R. L. Moses
*Attorney, Agent, or Firm*—Guy W. Shoup; Patrick T. Bever

[57] ABSTRACT

A process cartridge of an electrophotographic apparatus contains a photosensitive belt and an exposure device, whose positions are defined beforehand. The photosensitive belt is an endless belt having no connecting portion.

9 Claims, 8 Drawing Sheets

ELECTROPHOTOGRAPHIC IMAGE FORMING APPARATUS WITH PROCESS CARTRIDGE

BACKGROUND OF THE INVENTION

Field of the Invention

The present invention relates to an electrophotographic apparatus and, more particularly, to an electrophotographic apparatus which forms a desired image by forming an electrostatic latent image on a photosensitive member by means of an exposure device such as an LED head, developing the latent image and then transferring the developed imaged to a predetermined sheet of paper.

Description of the Related Art

An electrophotographic apparatus has been known which forms a desired image by forming an electrostatic latent image on a photosensitive member by means of an exposure device which employs an LED, a liquid crystal shutter, an EL, etc., developing the latent image and then transferring the developed imaged to a predetermined sheet of paper.

Such a conventional electrophotographic apparatus comprises, for example, a circular photosensitive belt which is rotatably provided inside the apparatus body. This photosensitive belt is cased in a process cartridge which is detachable from the apparatus body. A charging unit, an exposure device such as an LED head, a developing unit, etc., are arranged adjacent to the photosensitive member.

In a conventional electrophotographic apparatus, the charging unit makes the photosensitive belt ready for writing-in (formation of an electrostatic latent image thereon), before the exposure device forms an electrostatic latent image on the photosensitive belt according to predetermined print signals. The developing unit applies toner to the electrostatic latent image which is formed on the photosensitive belt in order to form a visible toner image. The toner image is transferred to a predetermined paper sheet, and then the transferred toner image is fixed. A desired image is thus obtained on the paper sheet.

The above-described photosensitive belt is circularly formed by connecting both ends thereof. Thus, a connecting portion is formed in the photosensitive belt. Because formation of a photosensitive layer becomes uneven in the connecting portion, the connecting portion cannot be used for formation of a latent image. Therefore, in the conventional art, the connecting portion is identified in order to control the exposure so that such portion is not exposed.

Since the connecting portion of the photosensitive belt cannot be used for exposure; in other words, since a latent image according to print signals must be formed on the rest portion of the photosensitive belt, it is required for the photosensitive belt to have a length corresponding to the length of a print paper sheet. This substantially long photosensitive belt results in a large process cartridge and, therefore, a large apparatus body.

Also, because a photosensitive belt and a exposure device are separate in the conventional art, a very precise positioning of a photosensitive belt with respect to an exposure device is required each time the photosensitive belts are changed after a certain period of service. Thus, the operation of changing photosensitive members is difficult. In addition, since the apparatus body must comprise a positioning means for the photosensitive belt or the exposure device, a complicated construction and a large number of parts thereof result, causing high production costs.

SUMMARY OF THE INVENTION

Therefore, it is on object of the present invention to provide an electrophotographic apparatus in which a photosensitive belt is small and a process cartridge containing the photosensitive belt can be easily mounted to and dismounted from the apparatus body.

To achieve the above object, an electrophotographic apparatus according to the present invention comprises a body and a process cartridge which is removably set in the body, the process cartridge containing: a photosensitive member to which toner is electrostatically adhered and from which the toner is transferred to a paper sheet; and an exposure device which is provided close to the photosensitive member and which forms, on the photosensitive member, an electrostatic latent image to which toner is adhered.

According to the present invention, since the photosensitive member is an endless belt, the entire surface thereof can be used to form an electrostatic latent image. Therefore, even if the surface of the photosensitive member is shorter than the length of a printing paper sheet, it can provide a properly formed electrostatic latent image. Thus, the photosensitive member can be made small, enabling a small process cartridge and also a small electrophotographic apparatus. Also, since both the photosensitive member and exposure device are contained in the process cartridge, the procedure for positioning the exposure device is eliminated when the photosensitive member is replaced. Thus, setting and removing the process cartridge is easy. Further, since the exposure device can be removably set in the process cartridge, the service life of an exposure device can be fully utilized.

Further objects, features and advantages of the present invention will become apparent in the following description of the preferred embodiments with reference to the attached drawings.

DESCRIPTION OF THE PREFERRED EMBODIMENTS

The preferred embodiments of the present invention will be described hereinafter with reference to FIGS. 1 to 13.

Figure 1:
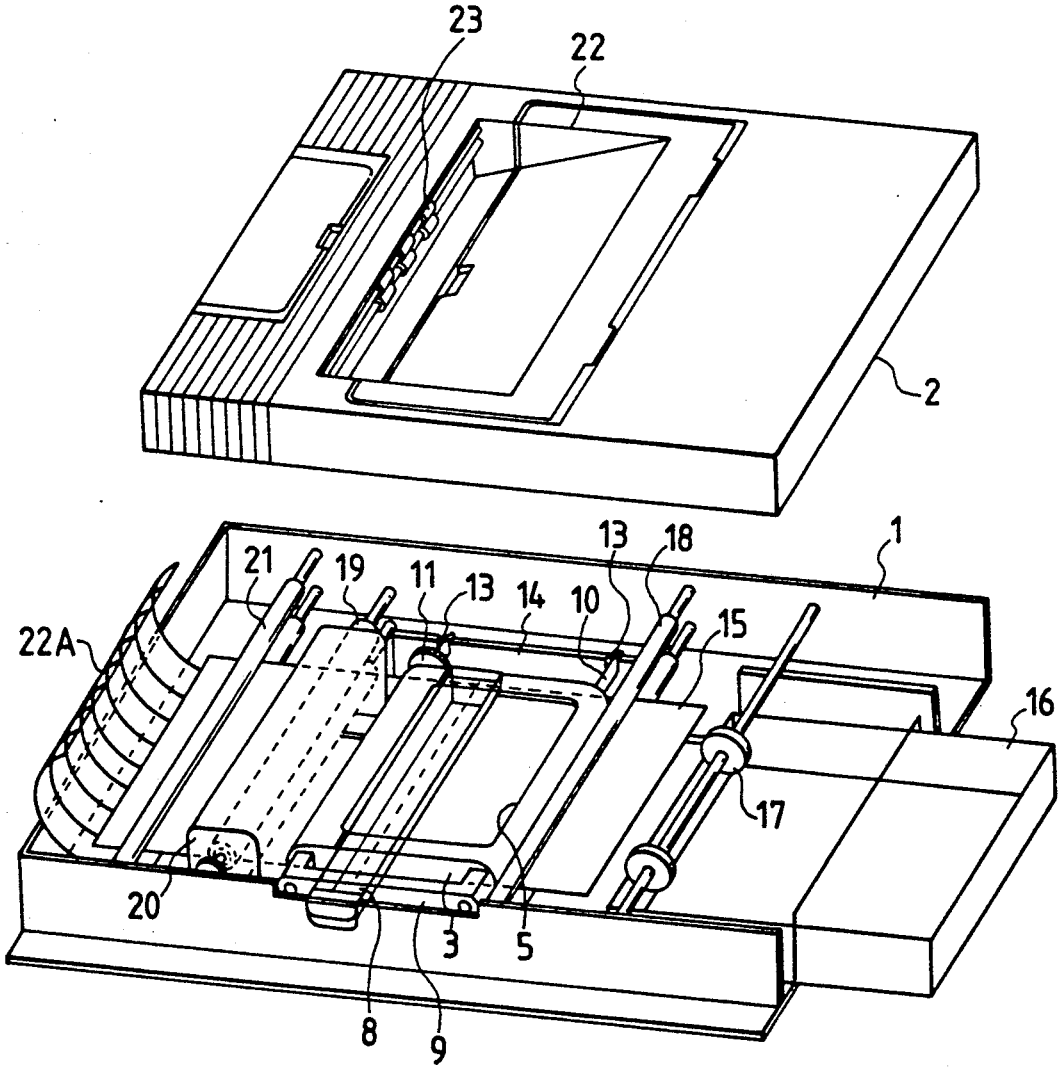
FIG. 1 is an exploded perspective view of an electrophotographic apparatus according to one embodiment of the present invention.
Figure 2:
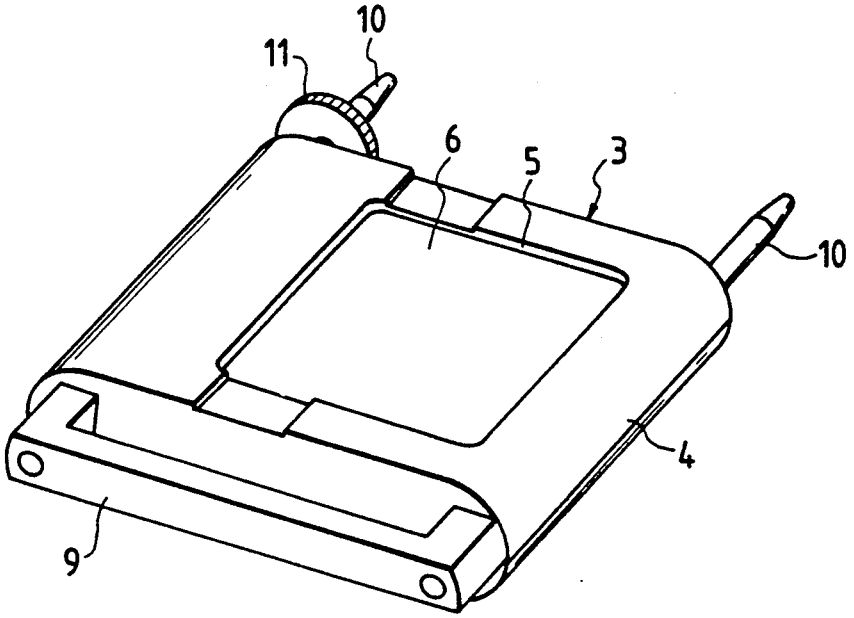
FIG. 2 is a front perspective view of the process cartridge shown in FIG. 1.
Figure 3:
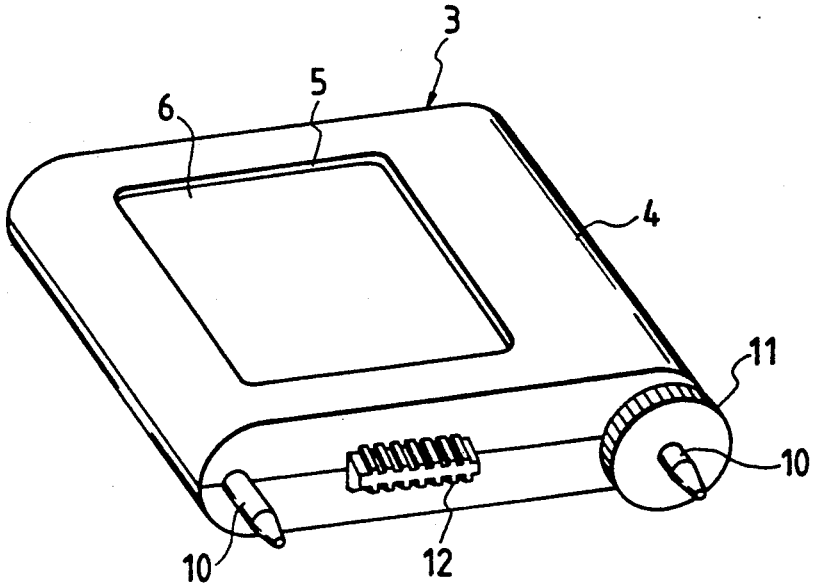
FIG. 3 is a rear perspective view of the process cartridge shown in FIG. 1.
Figure 4:
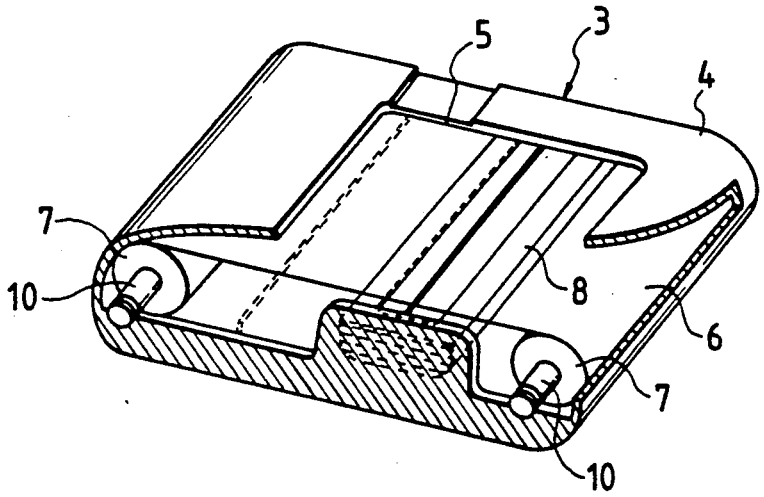
FIG. 4 is a partially-sectioned perspective view of the process cartridge shown in FIG. 1.

Referring to FIG. 1, an electrophotographic apparatus according to one embodiment of the present invention comprises a box-like body 1 and a cover member 2. The body 1 houses a process cartridge 3 which is detachable from a side portion of the body 1. As shown in FIGS. 2 to 4, the process cartridge 3 comprises a casing 4 which has an opening 5 in its top portion. The casing 4 contains a photosensitive belt 6, as a photosensitive member, which is made of a transparent base member and a photoconductive layer formed thereon. The photosensitive belt 6 is an endless belt and has no connecting portion. The photosensitive belt 6 is placed around a pair of drive rollers 7, 7 which are rotatably provided inside the casing 4. A portion of the photosensitive belt 6 faces the opening 5. The casing 4 also contains an exposure device 8, such as an LED array head, which is placed in a space formed by the photosensitive belt 6, close to the inside surface of the photosensitive belt 6. The exposure device 6 emits light according to an image signal. The light goes through the transparent base member of the photosensitive belt 6 and reaches the photoconductive layer thereof. Thus, a desired electrostatic latent image is formed on the photoconductive layer. A handle 9 is connected to a side portion of the casing 4 so as to be used for mounting and dismounting the process cartridge 3. Through the opposite side portion of the casing 4, drive shafts 10, 10 of the drive rollers 7, 7 protrude outwards. One of the drive shafts 10, 10 is connected to a transmission gear 11, which engages with a drive gear rotated by a driving means (not shown). A terminal 12 is formed at an end portion of the exposure device 8 and also protrudes outwards through the same side portion. The terminal 12 is connected to a not-shown terminal provided in the body 1 to supply electric power to the exposure device 8. The terminal 12 has a shape in which it becomes narrower toward its end so that it is easily connected to the terminal of the body 1. Contact points are formed on the upper and lower surfaces of the terminal 12.

Figure 5:
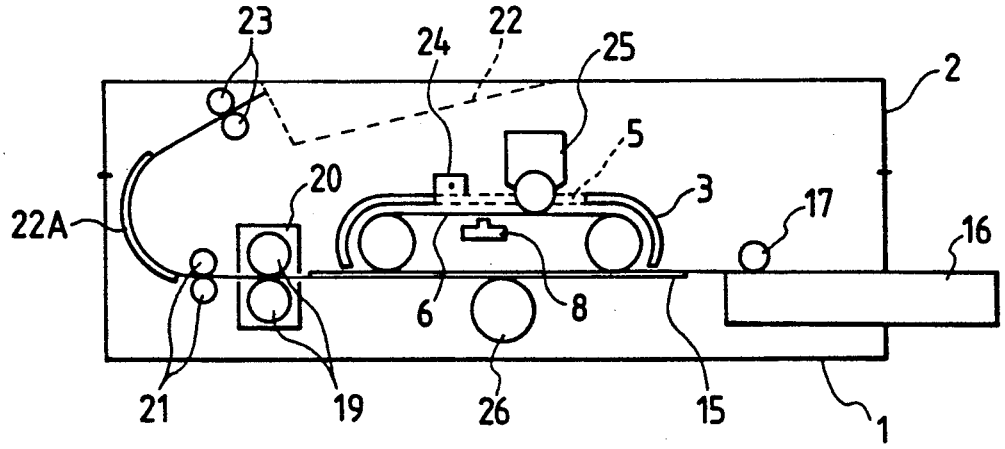
FIG. 5 schematically illustrates construction of the electrophotographic apparatus shown in FIG. 1.
Figure 6:
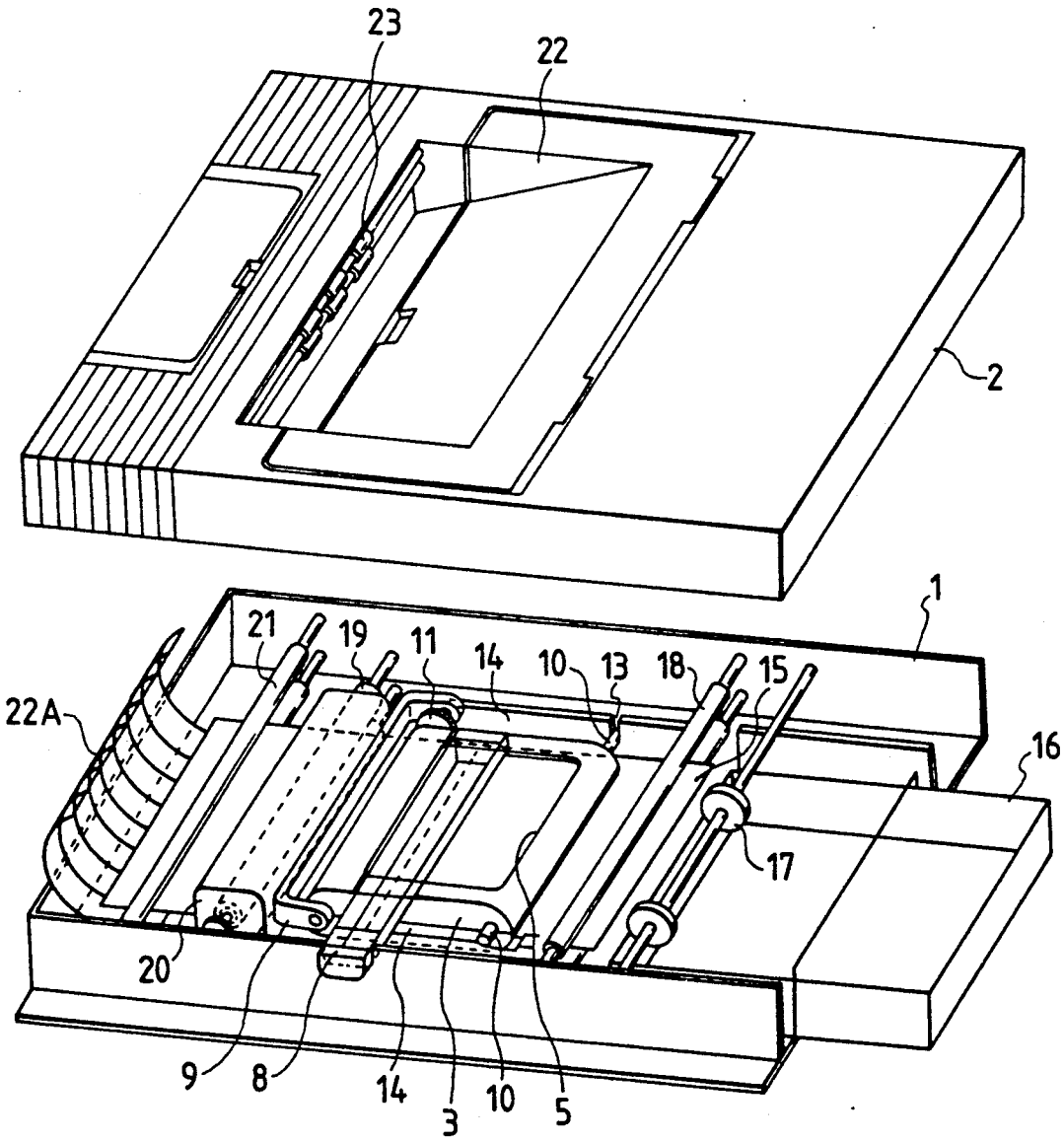
FIG. 6 is an exploded perspective view of an electrophotographic apparatus according to another embodiment of the present invention.
Figure 7:
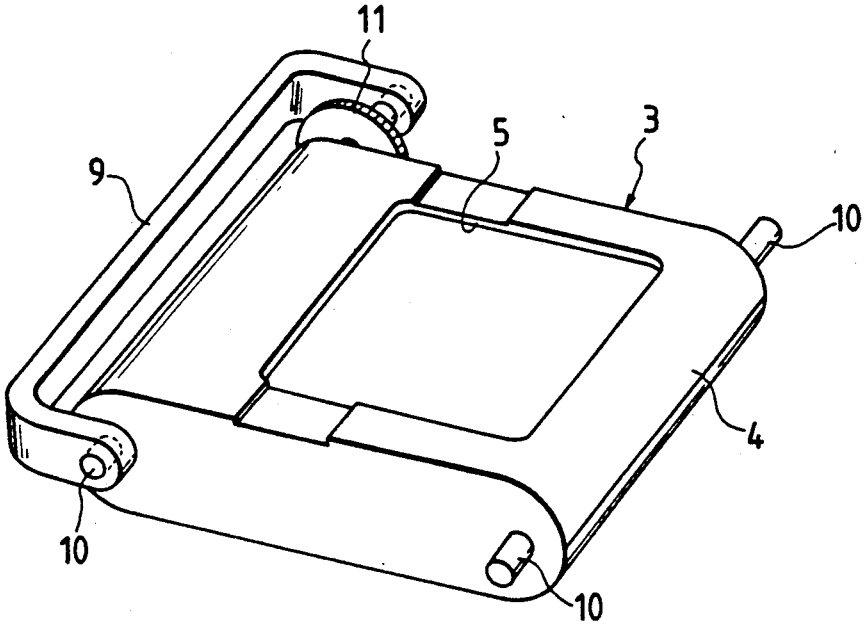
FIG. 7 is a front perspective view of the process cartridge shown in FIG. 6.
Figure 8:
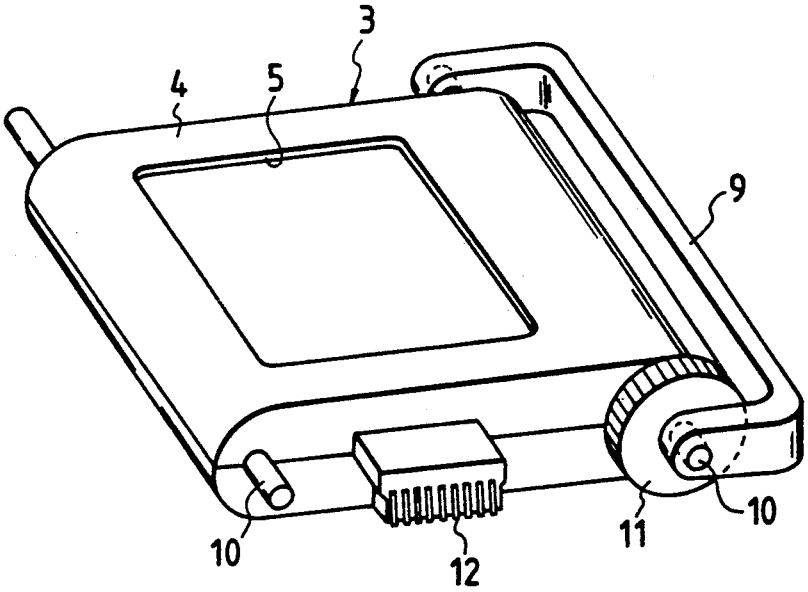
FIG. 8 is a rear perspective view of the process cartridge shown in FIG. 6.
Figure 9:
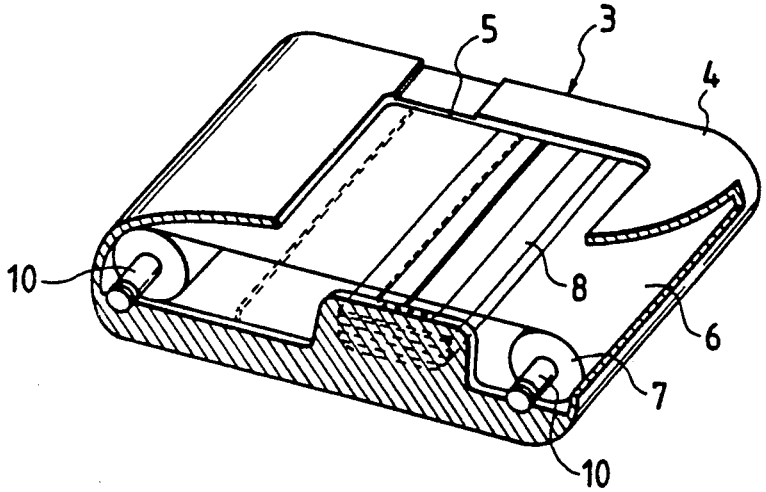
FIG. 9 is a partially-sectioned perspective view of the process cartridge shown in FIG. 6.
Figure 10:
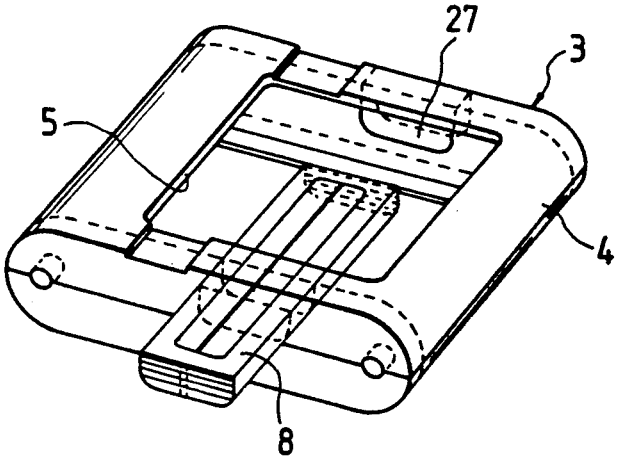
FIG. 10 is a perspective view of a process cartridge according to still another embodiment of the present invention.

The body 1 comprises a guiding member (not shown) for guiding the process cartridge 3. A shaft supporting plate 14 is provided at a side portion inside the body 1. The shaft supporting plate 14 has grooves which bear the drive shafts 10 of the process cartridge 3. As shown in FIG. 5, a charger 24 and a developer 25 are provided near the opening 5 of the process cartridge 3 set in the body 1. The charger 24 evenly charges the surface of the photosensitive belt 6. The developer 25 applies toner to an electrostatic latent image which is formed on the photosensitive belt 6 so as to form a visible image. A transferrer 26 is provided at another side of the circular photosensitive belt 6, i.e., a side thereof remote from the opening 5 of the process cartridge 3. The transferrer 26 transfers a visible toner image from the photosensitive belt 6 to a paper sheet 15. The transferrer 26 is formed in a cylindrical shape. It receives a bias voltage of a polarity opposite to the charge polarity of the toner. Thus, the transferrer 26 gives a paper sheet a pressing force and an electric field so as to ensure favorable transfer of a toner image to a paper sheet.

As shown in FIGS. 1 and 5, a paper feeder 16 storing paper sheets 15 is detachably connected to a side portion of the body 1. Hopping rollers 17 and feeding rollers 18 are provided close to the feeder 16. The hopping rollers 17 send out the paper sheets 15 from the feeder 16 one at a time, and the feeling rollers 18 convey the sent-out paper sheet over the top surface of the process cartridge 3. A fuser 20 composed of a pair of heat rollers 19, 19 is provided down the paper conveyance course from the paper cartridge 3. Conveying rollers 21 are provided down from the fuser 20. The conveying rollers 21 convey the paper sheet 15 from the fuser 20 toward the cover member 2. The top portion of the cover member 2 is provided with a recessed paper-discharge tray 22. Discharging rollers 23 are provided at one end portion of the paper-discharge tray 22. The discharging rollers 23 discharge the paper sheets 15 conveyed by the conveying rollers 21 onto the paper-discharge tray 22.

A curved guiding plate 22A is provided downstream from the conveying rollers 21. It guides a paper sheet 15 towards the paper-discharge tray 22.

Operation of the present invention will be described hereinafter.

Operation to form a desired image will be first described. A paper sheet 15 is stuck out from the feeder 16 by hopping rollers 17 and is conveyed toward the process cartridge 3 by the feeding rollers 18. The charger 24 evenly charges the photosensitive belt 6 to make it ready for writing-in, and then, according to a predetermined printing signal, the exposure device 8 irradiates the photosensitive belt 6 from its inside surface through the transparent base member so as to form an electrostatic latent image thereon.

The developer 25 applies toner to the electrostatic latent image formed on the photosensitive belt 6 so as to form a visible toner image. Then, the transferrer 26 transfers the toner image to the paper sheet conveyed thereto by the feeding rollers 18. After the paper sheet 15 is separated from the photosensitive belt 6, it is conveyed to the fuser 20. While the paper sheet 15 is conveyed between the heat rollers 19 of the fuser 20, the transferred toner image on the paper sheet 15 is fixed. The paper sheet 15 is further conveyed by the conveying rollers 21 and then is discharged onto the paper-discharge tray 22 by the discharging rollers 23.

To set the process cartridge 3 in the body 1, the operator grips the handle 9 of the process cartridge 3 and inserts it into the body 1 from a side portion thereof. Guided by the guiding member, the process cartridge 3 is inserted to a predetermined position, where the drive shafts 10 of the process cartridge 3 engage with the grooves 13 of the shaft supporting plate 14 of the body 1. Further, at this position, the transmission gear 11 of one of the drive shafts 10 engages with the not-shown drive gear provided in the body 1. Thus, the drive rollers 7 can be rotated by the driving means provided in the body 1.

The process cartridge 3 can be removed from the body 1 in the reversed procedure simply by gripping the handle 9 and drawing out the process cartridge 3 along the guiding member.

According to this embodiment of the present invention, since the photosensitive belt 6 has no connecting portion, the entire surface thereof can be used to form an electrostatic latent image. Therefore, even if the photosensitive belt 6 is shorter than the length of a sheet of printing paper, it can provide a properly formed electrostatic latent image. Thus, the photosensitive belt 6 can be made small, enabling a small process cartridge 3 and also a small electrophotographic apparatus. Also, since both the photosensitive belt 6 and exposure device 8 are contained in the process cartridge 3, the procedure for positioning the exposure device 8 is eliminated when the photosensitive belt 6 is replaced. Thus, setting and removing the process cartridge 3 is easy. In addition, since means for positioning the exposure device 8 or the photosensitive belt 6 is unnecessary, construction of the apparatus can be simplified and production costs can be reduced.

FIGS. 6 to 9 illustrates another embodiment of the present invention in which a process cartridge 3 is set into a body 1 from a top portion thereof.

According to this embodiment, the process cartridge 3 comprises a casing 4 having an opening 5 in its top portion. The casing 4 houses a pair of drive rollers 7 and a circular photosensitive belt 6 having no connecting portion and being placed around the drive rollers 7 so that a portion of the photosensitive belt 6 faces the opening 5. An exposure device 8 is provided extending in a space surrounded by the photosensitive belt 6 and close to the inside surface of photosensitive belt 6. An end portion of the exposure device 8 protrudes out from a side portion of the casing 4. The protruding portion of the exposure device 8 forms a terminal 12 and has contact points formed on a lower surface of the terminal 12. Drive shafts 10 of the drive rollers 7 protrude out from opposing side portions of the casing 4. One of the drive shafts 10 is connected to a transmission gear 11, which engages with a not-shown drive gear provided inside the body 1. The drive shaft 10 having the transmission gear 11 is also connected to a handle 9, which is used for mounting and dismounting the process cartridge 3.

Shaft supporting plates 14 are provided inside the body 1, near the above-mentioned opposing side portions of the casing 4 which is set in the body 1. Each of the shaft supporting plates 14 has a groove 13 formed at one end portion thereof, which bears the drive shaft 10 that is not connected to the transmission gear 11. The other end portion of each supporting plate 14 supports the handle 9.

The rest of the construction of this embodiment is substantially the same as that of the foregoing embodiment and will not be described hereinafter.

According to this embodiment, to set the process cartridge 3 into the body 1, the operator removes the cover member 2, grips the handle 9 of the process cartridge 3, and then inserts it into the body 1 from a top portion thereof. The process cartridge 3 is set in a predetermined position by engaging the drive shaft 10 not having the transmission gear 11 with the grooves 13 of the shaft supporting plates 14 and placing the handle 9 onto the top of the other end portions of the shaft supporting plates 14. At this position, the transmission gear 11 engages with the drive gear provided in the body 1.

The process cartridge 3 can be removed from the body 1 in a reversed procedure simply by gripping the handle 9 and lifting up the process cartridge 3.

As in the foregoing embodiment, according to this embodiment, since the photosensitive belt 6 has no connecting portion, the entire surface thereof can be used to form an electrostatic latent image. Therefore, even if the photosensitive belt 6 is shorter than the length of a printing paper sheet, it can provide a properly formed electrostatic latent image. Thus, the photosensitive belt 6 can be made small, enabling a small process cartridge 3 and then a small electrophotographic apparatus. Also, since both the photosensitive belt 6 and exposure device 8 are contained in the process cartridge 3, the procedure for positioning the exposure device 8 is eliminated when the photosensitive belt 6 is replaced. Thus, setting and removing the process cartridge 3 is easy. In addition, construction of the apparatus can be simplified and production costs can be reduced.

FIGS. 10 to 13 illustrate still another embodiment of the present invention in which an exposure device 8 is provided removable with respect to a process cartridge 3.

Figure 13:
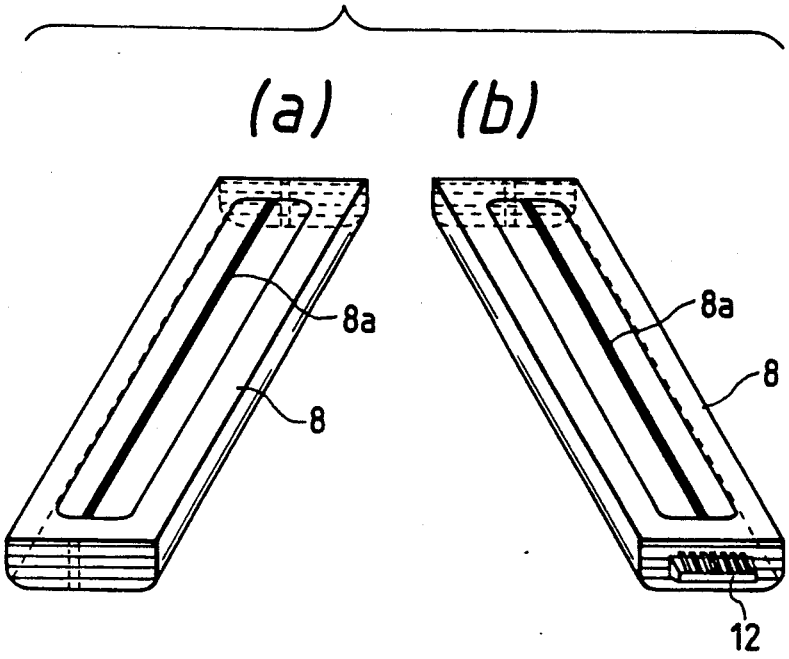
FIGS. 13(*a*) and 13(*b*) are front and rear perspective views of the exposure device shown in FIG. 10.

According to this embodiment, the process cartridge 3 comprises a casing 4 having not only an opening 5 in its top surface but also openings 27 in opposing side portions thereof. The openings 27 guide and support the exposure device 8. As shown in FIG. 13, the exposure device 8 comprises a light emitting portion 8*a*, such as an LED, formed on a surface thereof and a terminal 12 formed on an end portion thereof. The exposure device 8 is thus unitized. The exposure device 8 is removably inserted in the casing 4. While supported by portions around the openings 27, the exposure device 8 is placed in a predetermined position such that the light emitting portion 8*a* takes a position close to the inside surface of a photosensitive belt (not shown). The terminal 12 of the exposure device 8 protrudes from a side portion of the casing 4 so that when the process cartridge 3 is set in the body, the terminal 12 is connected to a terminal provided in the body.

Figure 11:
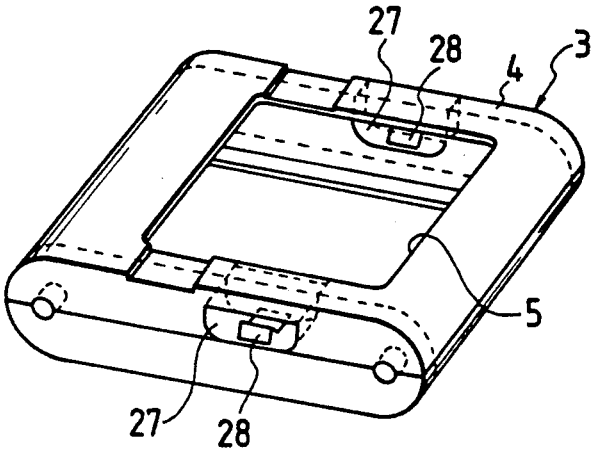
FIG. 11 is a perspective view of a process cartridge according to a further embodiment of the present invention.
Figure 12:
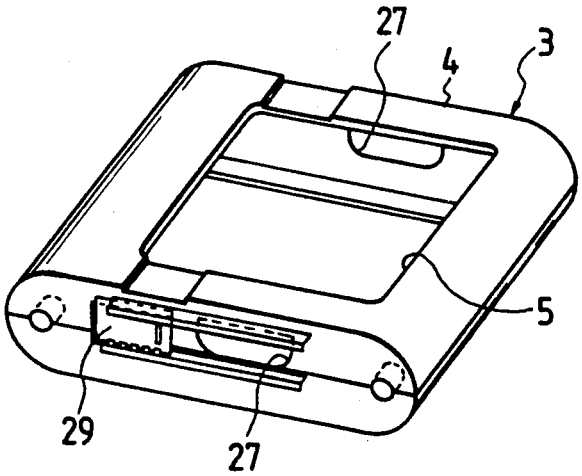
FIG. 12 is a perspective view of a process cartridge according to a still further embodiment of the present invention.
Figure 14:
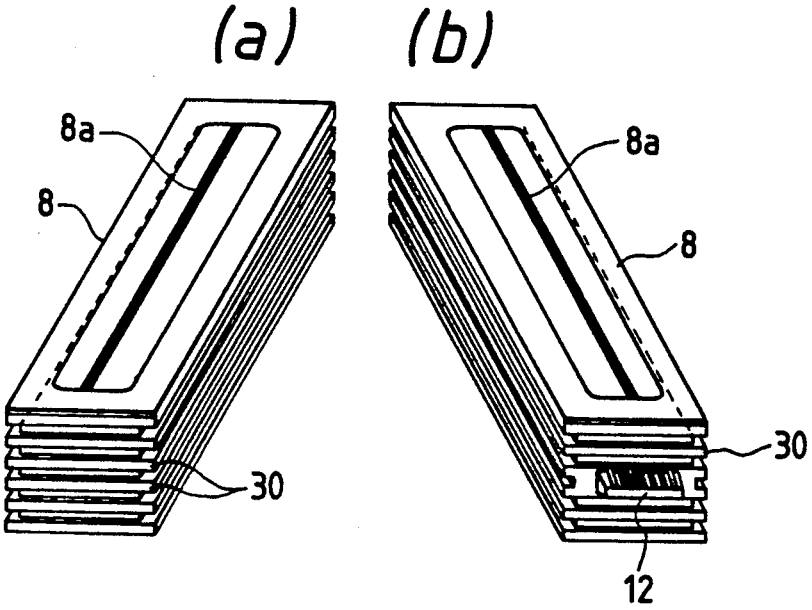
FIGS. 14(*a*) and 14(*b*) are font and rear perspective views of an exposure device according to yet another embodiment of the present invention.

As shown in FIG. 11, the portions around the openings 27 may be provided with elastic lugs 28 which hold the exposure device 8 at the predetermined position and keep the exposure device 8 from slipping off from the openings 27. Further, as shown in FIG. 12, a lid member 29 may be provided on the side portion of the casing 4, i.e., the side from which the exposure device 8 is inserted into the casing 4. The lid member 29 is slidable so as to keep the exposure device 8 from slipping off from the opening 27. As shown in FIG. 14, cooling fins 30 may be formed on outside surfaces of the exposure device 8. The cooling fins 30 will help release the heat from the exposure device 8.

According to this embodiment, the exposure device 8 can be removably set in the process cartridge 3 simply by inserting the exposure device 8 through the openings 27 of the process cartridge 3. Therefore, for example, if the exposure device 8 is still in serviceable condition when the photosensitive belt is to be replaced, the exposure device 8 can be still used by setting it in another process cartridge 3 containing a new photosensitive belt 6. Thus, the service life of an exposure device 8 can be fully utilized.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

According to the electrophotographic apparatus of the present invention, since the photosensitive member has no connecting portion, the entire surface thereof can be used to form an electrostatic latent image. Therefore, even if the photosensitive member is shorter than the length of a printing paper sheet, it can provide a properly formed electrostatic latent image. Thus, the photosensitive member can be made small, enabling a small process cartridge and also a small electrophotographic apparatus. Also, since both the photosensitive member and exposure device are contained in the process cartridge, the procedure for positioning the exposure device is eliminated when the photosensitive member is replaced. Thus, setting and removing the process cartridge is easy. In addition, since means for positioning the exposure device or the photosensitive member is unnecessary, construction of the apparatus can be simplified and production costs can be substantially reduced.

What is claimed is:

1. An electrophotographic apparatus having a body and a process cartridge which is removably set in said body, said process cartridge comprising:

a photosensitive member to which toner is electrostatically adhered and from which the toner is transferred to a paper sheet, and wherein said photosensitive member includes an endless surface formed as a loop; and an exposure device disposed inside the loop formed by said photosensitive member and which forms, on said photosensitive member, an electrostatic latent image to which toner is adhered.

2. An electrophotographic apparatus according to claim 1, wherein said photosensitive member is a belt.

3. An electrophotographic apparatus according to claim 1, wherein said photosensitive member is an endless belt having no connecting portion.

4. An electrophotographic apparatus according to claim 1, wherein said exposure device is removable from said process cartridge.

5. An electrophotographic apparatus according to claim 4, wherein said process cartridge is provided with an opening through which said exposure device is set into and removed from said process cartridge.

6. An electrophotographic apparatus according to claim 1, wherein said exposure device comprises a cooling fin formed on an outside surface thereof.

7. An electrophotographic apparatus according to claim 1, wherein said process cartridge is provided with a handle which is used when said process cartridge is set in and removed from said body.

8. An electrophotographic apparatus according to claim 1, wherein said exposure device is an LED array head.

9. The electrophotographic apparatus of claim 7 wherein the handle is movably mounted onto said process cartridge.

* * * * *